US009577332B2

(12) United States Patent
Chen et al.

(10) Patent No.: US 9,577,332 B2
(45) Date of Patent: Feb. 21, 2017

(54) ELECTRONIC DEVICE AND MULTI-BAND ANTENNA

(71) Applicant: HON HAI PRECISION INDUSTRY CO., LTD., New Taipei (TW)

(72) Inventors: Wei-Yu Chen, New Taipei (TW); Yueh-Chu Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/797,831

(22) Filed: Jul. 13, 2015

(65) Prior Publication Data

US 2016/0352014 A1 Dec. 1, 2016

(30) Foreign Application Priority Data

May 27, 2015 (CN) ..... 2015 1 0276463

(51) Int. Cl.
*H01Q 1/38* (2006.01)
*H01Q 5/50* (2015.01)

(52) U.S. Cl.
CPC ..... *H01Q 5/50* (2015.01)

(58) Field of Classification Search
CPC ..... H01Q 7/00; H01Q 1/2208; H01Q 21/28; H01Q 1/2216; H01Q 5/371; H01Q 5/328; H01Q 1/243
See application file for complete search history.

(56) References Cited

U.S. PATENT DOCUMENTS 7,616,158 B2 * 11/2009 Mak ..... H01Q 1/243 343/700 MS
8,217,841 B2 * 7/2012 Hossain ..... H01Q 1/243 343/700 MS
8,742,999 B2 * 6/2014 Amari ..... H01Q 9/0407 343/700 MS
8,836,587 B2 * 9/2014 Darnell ..... H01Q 1/243 343/700 MS
2007/0069956 A1 * 3/2007 Ozkar ..... H01Q 5/00 343/700 MS
2009/0009401 A1 * 1/2009 Suzuki ..... H01Q 1/242 343/700 MS
2009/0273523 A1 * 11/2009 Sakuma ..... H01Q 1/243 343/700 MS
2009/0285262 A1 * 11/2009 Kim ..... H01Q 1/243 375/130

(Continued)

*Primary Examiner* — Linh Nguyen
(74) *Attorney, Agent, or Firm* — Zhigang Ma

(57) ABSTRACT

An electronic device has a multi-band antenna which includes an antenna frame and multiple feed points and multiple ground points located on the antenna frame. The multiple feed points include a first feed point located at one end portion of the antenna frame and a second feed point located between two end portions of the antenna frame. The multiple ground points include a first ground point located between the two end portions of the antenna frame and a second ground point located at the other end portion of the antenna frame. The multiple feed points and the multiple ground points are alternately located on the antenna frame, and multiple radiating elements are formed on the antenna frame and are configured to radiate signals having different frequency bands. Each radiating element is formed between a feed point and a ground point.

18 Claims, 3 Drawing Sheets

(56) References Cited

U.S. PATENT DOCUMENTS

| | | | | |
|---|---|---|---|---|
| 2010/0328164 | A1* | 12/2010 | Huynh | H01Q 1/243<br>343/702 |
| 2012/0001812 | A1* | 1/2012 | Zhao | A61N 1/37229<br>343/718 |
| 2015/0116168 | A1* | 4/2015 | Yosui | H01Q 7/00<br>343/722 |
| 2015/0200448 | A1* | 7/2015 | Tsai | H01Q 1/243<br>343/702 |

* cited by examiner

ELECTRONIC DEVICE AND MULTI-BAND ANTENNA

CROSS-REFERENCE TO RELATED APPLICATIONS

This application claims priority to Chinese Patent Application No. 201510276463.5 filed on May 27, 2015, the contents of which are incorporated by reference herein.

FIELD

The subject matter herein generally relates to wireless communication technology, and particularly to an electronic device having a multi-band antenna.

BACKGROUND

Existing electronic devices are equipped with multiple antennas for radiating different signal types. However, multiple antennas occupy a large area of the electronic device, and electromagnetic interference is also generated among the multiple antennas.

BRIEF DESCRIPTION OF THE DRAWINGS

Implementations of the present disclosure will now be described, by way of example only, with reference to the attached figures.

DETAILED DESCRIPTION

Figure 1:
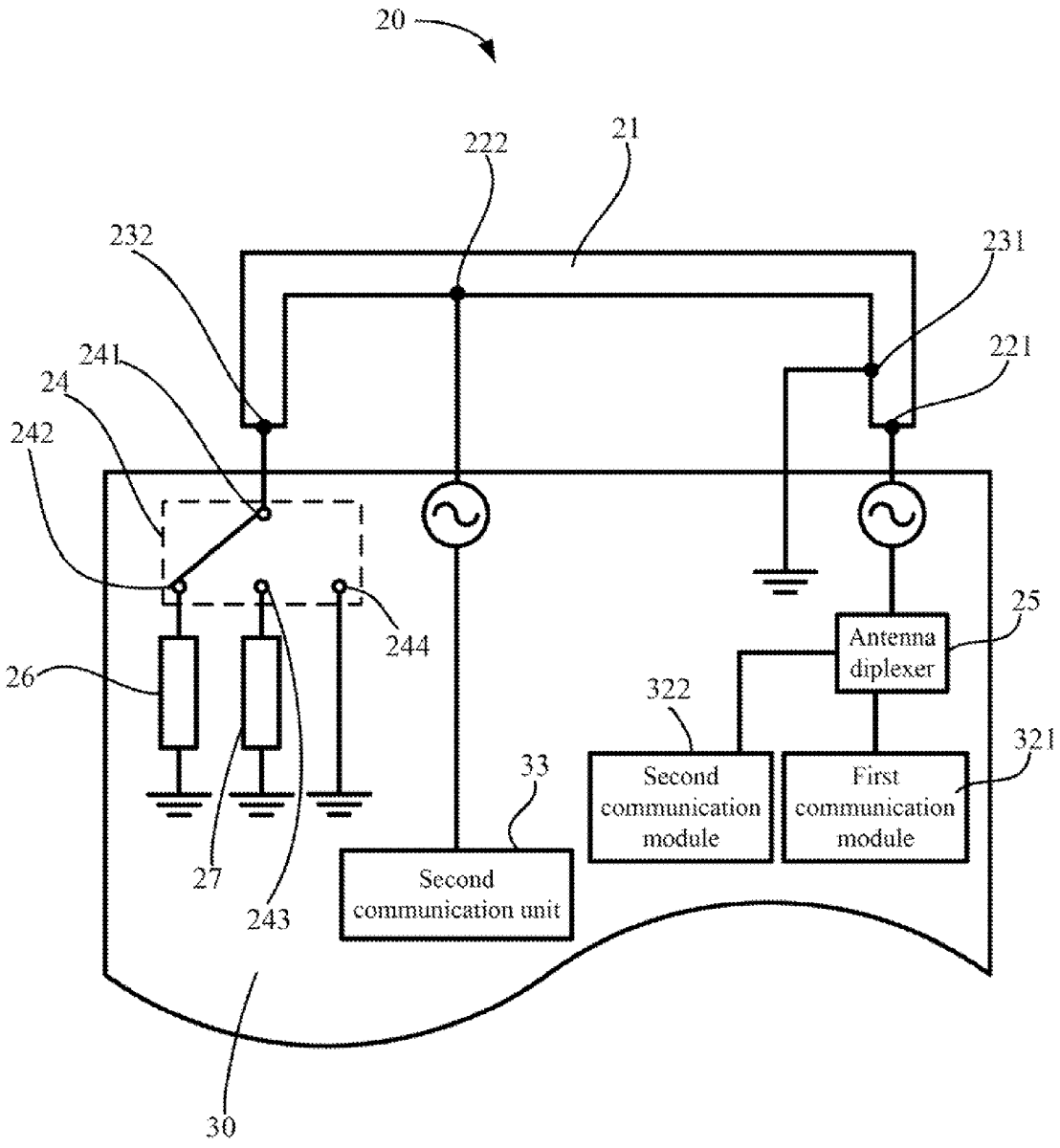
FIG. 1 is a diagrammatic view of an embodiment of a multi-band antenna.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts can be exaggerated to better illustrate details and features. The present disclosure, including the accompanying drawings, is illustrated by way of examples and not by way of limitation.

Several definitions that apply throughout this disclosure will now be presented.

It should be noted that references to "a/an" or "one" embodiment in this disclosure are not necessarily to the same embodiment, and such references mean "at least one." Furthermore, the term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected.

Figure 2:
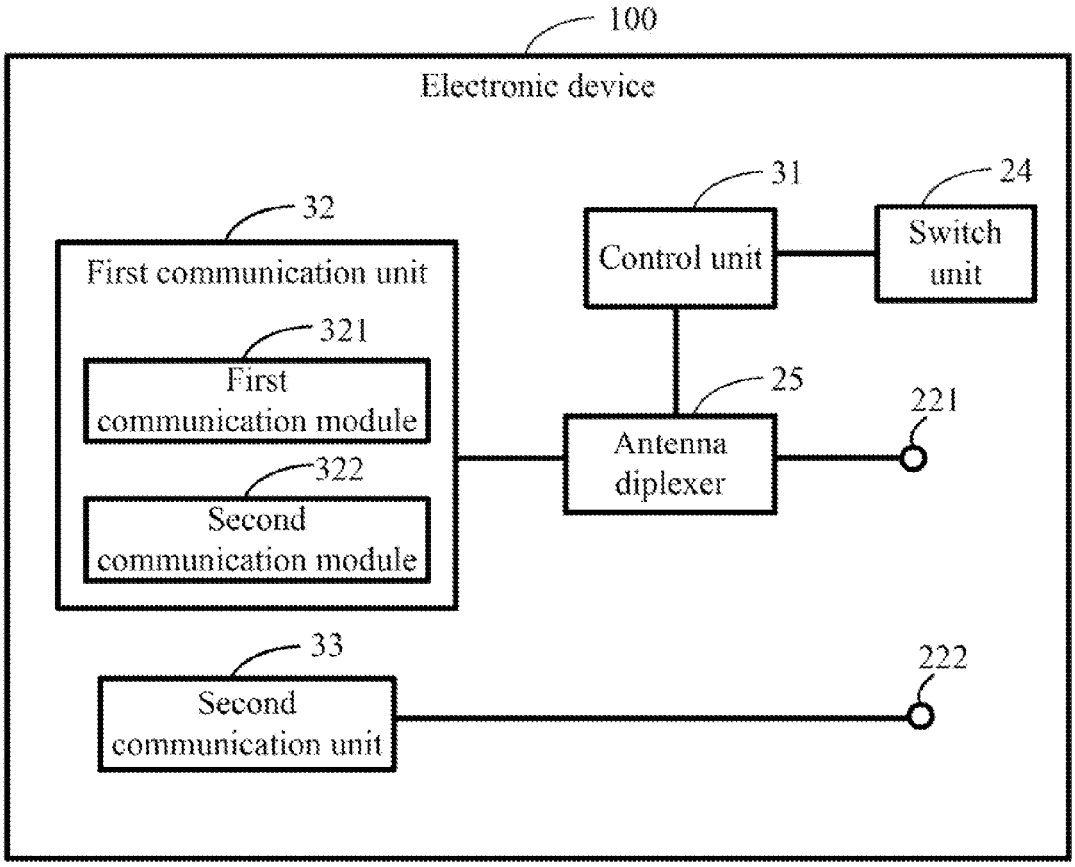
FIG. 2 is a block diagram of an embodiment of an electronic device having the antenna of FIG. 1.

FIG. 1 is a diagrammatic view of an embodiment of a multi-band antenna. In the embodiment as shown in FIG. 1, a multi-band antenna 20 is applied to an electronic device 100 (as shown in FIG. 2). The electronic device 100 can be mobile phones, tablets, or any other suitable electronic devices. The electronic device 100 further includes a circuit board 30 for mounting of the antenna 20.

The antenna 20 includes an antenna frame 21, multiple feed points and multiple ground points located on the antenna frame 21. In the embodiment, the antenna frame 21 has two end portions. The multiple feed points include a first feed point 221 located at one end portion of the antenna frame 21 and a second feed point 222 located between the two end portions of the antenna frame 21. The multiple ground points include a first ground point 231 located between the two end portions of the antenna frame 21 and a second ground point 232 located at the other end portion of the antenna frame 21.

In the embodiment, the multiple feed points and the multiple ground points are alternately located on the antenna frame 21, and multiple radiating elements are formed on the antenna frame 21 and are configured to radiate signals having different frequency bands. In the embodiment, each radiating element is formed between a feed point and a ground point.

FIG. 2 shows the embodiment of the electronic device 100 further includes a first communication unit 32 electrically coupled to the first feed point 221, and a second communication unit 33 electrically coupled to the second feed point 222. FIG. 2 illustrates only one example of the electronic device 100, other examples can comprise more or fewer components than illustrated, or have a different configuration of the various components. In the embodiment, the first communication unit 32 includes a first communication module 321 for generating and/or receiving signals belonging to a first frequency band and a second communication module 322 for generating and/or receiving signals belonging to a second frequency band. In the embodiment, the first communication unit 32 is electrically coupled to the first feed point 221 through an antenna diplexer 25.

In the embodiment, the electronic device 100 further includes a switch unit 24 electronically coupled between the second ground point 232 and ground. In the embodiment, the switch unit 24 includes a first connecting terminal 241 electrically coupled to the second ground point 232 and multiple connecting terminals being directly or indirectly grounded. The switch unit 24 is configured to selectively connect the first connecting terminal 241 to one of the multiple connecting terminals, to provide multiple pathways for connecting the second ground point 232 to ground.

FIG. 1 shows the embodiment of the multiple connecting terminals of the switch unit 24 includes a second connecting terminal 242 being grounded through a first matching element 26, a third connecting terminal 243 being grounded through a second matching element 27, and a fourth connecting terminal 244 being directly grounded. In the embodiment, the switch unit 24 can be a single pole triple throw switch.

FIG. 2 shows the embodiment of the electronic device 100 further includes a control unit 31 electronically coupled to the antenna diplexer 25 and the switch unit 24. The control unit 31 can be a central processing unit (CPU), or a microprocessor.

Figure 3:
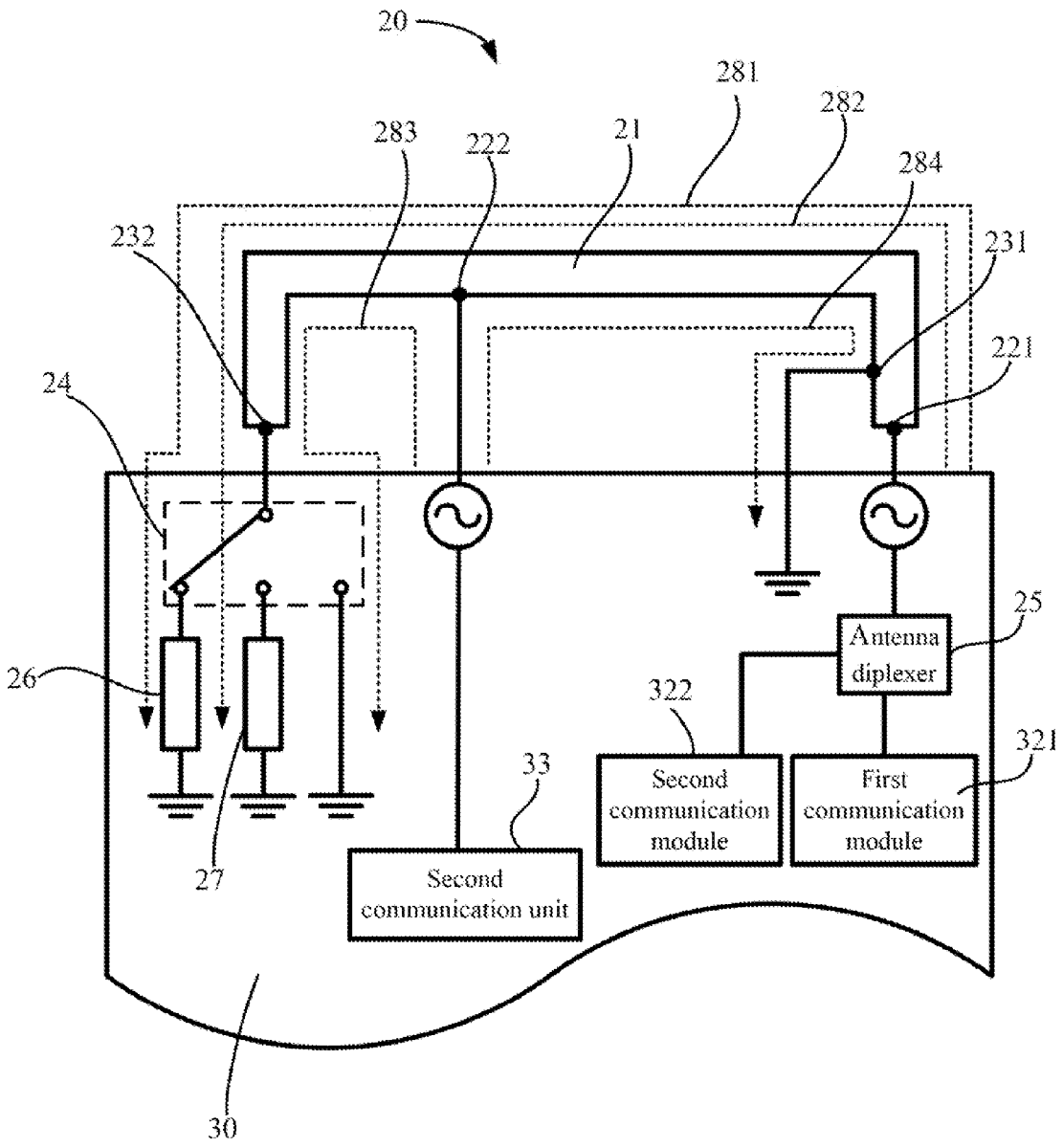
FIG. 3 is a diagrammatic view of an embodiment of signal pathways defined on the antenna of FIG. 1 when in use.

In use, when the antenna diplexer 25 tunes the antenna frequency to the first frequency band, the control unit 31 controls the switch unit 24 to synchronously connect the first connecting terminal 241 to the second connecting terminal 242, the second ground point 232 is thus grounded through the first matching element 26. That is, as shown in FIG. 3, a first pathway 281 is defined among the first feed point 221, the second ground point 232, the first matching element 26, and the ground. The radiating element formed between the first feed point 221 and the second ground point 232 is excited by the first matching element 26 and is operated on a first magnetic resonance mode to radiate signals belonging to the first frequency band.

When the antenna diplexer 25 tunes the antenna frequency to the second frequency band, the control unit 31 controls the switch unit 24 to synchronously connect the first connecting terminal 241 to the third connecting terminal 243, the second ground point 232 is thus grounded through the second matching element 27. That is, a second pathway 282 is defined among the first feed point 221, the second ground point 232, the second matching element 27, and the ground. The radiating element formed between the first feed point 221 and the second ground point 232 is excited by the second matching element 26 and is operated on a second magnetic resonance mode to radiate signals belonging to the second frequency band.

In the embodiment, the first communication module 321 is a Near Field Communication (NFC) module, the second communication module 322 is a Wireless Power Transmission (WPT) module, and the first feed point 221 is an antenna feed point of NFC signals and WPT signals. In the embodiment, the frequency of the NFC signals is 13.56 MHz, and the frequency of the WPT signals is 6.78 MHz.

When the switch unit 24 is controlled to connect the first connecting terminal 241 to the fourth connecting terminal 244, the second ground point 232 is directly grounded. That is, a third pathway 283 is defined among the second feed point 222, the second ground point 232, and the ground. The radiating element formed between the second feed point 222 and the second ground point 232 is excited and operated on a third magnetic resonance mode to radiate signals belonging to a third frequency band.

In the embodiment, the first ground point 231 is directly grounded. That is, a fourth pathway 284 is defined among the second feed point 222, the first ground point 231, and the ground. The radiating element formed between the second feed point 222 and the first ground point 231 is excited and operated on a fourth magnetic resonance mode to radiate signals belonging to a fourth frequency band In the embodiment, the second communication unit 33 is a cellular mobile communication network system, and the second feed point 222 is a cellular feed point. The cellular mobile communication network system includes, but is not limited to, a Global System for Mobile Communication (GSM) network system, a Universal Mobile Telecommunication System (UMTS), a Long-Term Evolution (LTE).

In the embodiment, the third frequency band is a high frequency band having frequency between 1710-2700 MHz, and a length of the radiating element formed between the second feed point 222 and the second ground point 232 is not greater than a quarter of the wavelength of the high frequency band. The fourth frequency band is a low or middle frequency band having frequency between 700-960 MHz, and a length of the radiating element formed between the second feed point 222 and the first ground point 231 is not greater than a quarter of the wavelength of the low frequency band, and is lower than three quarters of the wavelength of the middle frequency band.

The embodiments shown and described above are only examples. Even though numerous characteristics and advantages of the present technology have been set forth in the foregoing description, together with details of the structure and function of the present disclosure, the disclosure is illustrative only, and changes can be made in the detail, including in particular the matters of shape, size, and arrangement of parts within the principles of the present disclosure, up to and including the full extent established by the broad general meaning of the terms used in the claims.

What is claimed is:

1. A multi-band antenna comprising:

an antenna frame having two end portions;

multiple feed points located on the antenna frame, the multiple feed points comprising a first feed point located at one end portion of the antenna frame and electrically coupled to a first communication unit, and a second feed point located between the two end portions of the antenna frame and electrically coupled to a second communication unit, wherein the first feed point is electrically coupled to the first communication unit through an antenna diplexer, wherein the first communication unit comprises a first communication module for generating and/or receiving signals belonging to a first frequency band and a second communication module for generating and/or receiving signals belonging to a second frequency band; and multiple ground points located on the antenna frame, the multiple ground points comprising a first ground point located between the two end portions of the antenna frame and a second ground point located at the other end portion of the antenna frame;

wherein the multiple feed points and the multiple ground points are alternately located on the antenna frame, multiple radiating elements are formed on the antenna frame, the multiple radiating elements are configured to radiate signals having different frequency bands, and each radiating element is formed between a feed point and a ground point.

2. The antenna as described in claim 1, wherein the second ground point is grounded via a switch unit, wherein the switch unit comprising a first connecting terminal electrically coupled to the second ground point and multiple connecting terminals being directly or indirectly grounded, wherein the switch unit is configured to selectively connect the first connecting terminal to one of the multiple connecting terminals, to provide multiple pathways for connecting the second ground point to ground.

3. The antenna as described in claim 2, wherein the multiple connecting terminals of the switch unit comprise a second connecting terminal being grounded through a first matching element and a third connecting terminal being grounded through a second matching element.

4. The antenna as described in claim 3, wherein when the antenna diplexer tunes the antenna frequency to the first frequency band, and the switch unit is controlled to synchronously connect the first connecting terminal to the second connecting terminal, the second ground point is grounded through the first matching element, the radiating element formed between the first feed point and the second ground point is excited by the first matching element and is operated on a first magnetic resonance mode to radiate signals belonging to the first frequency band.

5. The antenna as described in claim 4, wherein when the antenna diplexer tunes the antenna frequency to the second frequency band, and the switch unit is controlled to synchronously connect the first connecting terminal to the third connecting terminal, the second ground point is grounded through the second matching element, the radiating element formed between the first feed point and the second ground point is excited by the second matching element and is operated on a second magnetic resonance mode to radiate signals belonging to the second frequency band.

6. The antenna as described in claim 2, wherein the multiple connecting terminals of the switch unit comprise a fourth connecting terminal being directly grounded; wherein when the switch unit is controlled to connect the first connecting terminal to the fourth connecting terminal, the second ground point is directly grounded, the radiating element formed between the second feed point and the second ground point is excited and operated on a third magnetic resonance mode to radiate signals belonging to a third frequency band.

7. The antenna as described in claim 1, wherein the first ground point is directly grounded, and the radiating element formed between the second feed point and the first ground point is excited and operated on a fourth magnetic resonance mode to radiate signals belonging to a fourth frequency band.

8. An electronic device comprising:

a first communication unit and a second communication unit; and a multi-band antenna comprising:

an antenna frame having two end portions;

multiple feed points located on the antenna frame, the multiple feed points comprising a first feed point located at one end portion of the antenna frame and electrically coupled to the first communication unit, and a second feed point located between the two end portions of the antenna frame and electrically coupled to the second communication unit, wherein the first feed point is electrically coupled to the first communication unit through an antenna diplexer, wherein the first communication unit comprises a first communication module for generating and/or receiving signals belonging to a first frequency band and a second communication module for generating and/or receiving signals belonging to a second frequency band; and multiple ground points located on the antenna frame, the multiple ground points comprising a first ground point located between the two end portions of the antenna frame and a second ground point located at the other end portion of the antenna frame;

wherein the multiple feed points and the multiple ground points are alternately located on the antenna frame, and multiple radiating elements are formed on the antenna frame, the multiple radiating elements are configured to radiate signals having different frequency bands, and each radiating element is formed between a feed point and a ground point.

9. The electronic device as described in claim 8, further comprising a switch unit electronically coupled between the second ground point and ground, wherein the switch unit comprising a first connecting terminal electrically coupled to the second ground point and multiple connecting terminals being directly or indirectly grounded, wherein the switch unit is configured to selectively connect the first connecting terminal to one of the multiple connecting terminals, to provide multiple pathways for connecting the second ground point to ground.

10. The electronic device as described in claim 9, wherein the multiple connecting terminals of the switch unit comprise a second connecting terminal being grounded through a first matching element and a third connecting terminal being grounded through a second matching element.

11. The electronic device as described in claim 10, further comprising a control unit electronically coupled to the antenna diplexer and the switch unit, wherein when the antenna diplexer tunes the antenna frequency to the first frequency band, the control unit controls the switch unit to synchronously connect the first connecting terminal to the second connecting terminal, the second ground point is thus grounded through the first matching element, the radiating element formed between the first feed point and the second ground point is excited by the first matching element and is operated on a first magnetic resonance mode to radiate signals belonging to the first frequency band.

12. The electronic device as described in claim 11, wherein when the antenna diplexer tunes the antenna frequency to the second frequency band, the control unit controls the switch unit to synchronously connect the first connecting terminal to the third connecting terminal, the second ground point is thus grounded through the second matching element, the radiating element formed between the first feed point and the second ground point is excited by the second matching element and is operated on a second magnetic resonance mode to radiate signals belonging to the second frequency band.

13. The electronic device as described in claim 12, wherein the first communication module is a Near Field Communication (NFC) module, the second communication module is a Wireless Power Transmission (WPT) module, and the first feed point is an antenna feed point of NFC signals and WPT signals.

14. The electronic device as described in claim 9, wherein the second communication unit is a cellular mobile communication network system, and the second feed point is a cellular feed point.

15. The electronic device as described in claim 14, wherein the multiple connecting terminals of the switch unit comprise a fourth connecting terminal being directly grounded; wherein when the switch unit is controlled to connect the first connecting terminal to the fourth connecting terminal, the second ground point is directly grounded, the radiating element formed between the second feed point and the second ground point is excited and operated on a third magnetic resonance mode to radiate signals belonging to a third frequency band.

16. The electronic device as described in claim 15, wherein the third frequency band is a high frequency band having frequency between 1710-2700 MHz, and a length of the radiating element formed between the second feed point and the second ground point is not greater than a quarter of the wavelength of the high frequency band.

17. The electronic device as described in claim 14, wherein the first ground point is directly grounded, and the radiating element formed between the second feed point and the first ground point is excited and operated on a fourth magnetic resonance mode to radiate signals belonging to a fourth frequency band.

18. The electronic device as described in claim 17, wherein the fourth frequency band is a low or middle frequency band having frequency between 700-960 MHz, and a length of the radiating element formed between the second feed point and the first ground point is not greater than a quarter of the wavelength of the low frequency band, and is lower than three quarters of the wavelength of the middle frequency band.

* * * * *